United States Patent [19]

Maros

[11] Patent Number: 4,540,224

[45] Date of Patent: Sep. 10, 1985

[54] GROUNDING CLIP FOR USE WITH SHIELDED, JACKETED FLAT CABLE

[75] Inventor: Ronald R. Maros, Itasca, Ill.

[73] Assignee: Cooper Industries, Inc., Houston, Tex.

[21] Appl. No.: 525,639

[22] Filed: Aug. 23, 1983

[51] Int. Cl.[3] ..... H01R 4/66

[52] U.S. Cl. ..... 339/14 R; 339/17 F; 339/143 R

[58] Field of Search ..... 339/17 F, 176 MF, 14 R, 339/143 R, 97 P; 174/117 F, 78, 84 C

[56] References Cited

U.S. PATENT DOCUMENTS 3,728,473 4/1973 Kuo ..... 174/84 C 3,757,029 9/1973 Marshall ..... 174/117 F X

*Primary Examiner*—Eugene F. Desmond

*Attorney, Agent, or Firm*—Fitch, Even, Tabin & Flannery

[57] ABSTRACT

A one-piece resilient metallic grounding clip for use with a shielded, jacketed flat cable. The clip includes a first arm, a second arm, a web joining the arms and defining therewith a channel for receiving the shielded portion of the cable, and an ear extending from the web for cooperating with one of the arms to deform a portion of the outer cable sheath. The spacing between the arms is less than the thickness of the shielded cable portion. Upon forming a slit in the outer sheath at one side of the cable, the arms can be moved from the side of the cable to flank the shielded portion of the cable and hold it compressively therebetween.

16 Claims, 9 Drawing Figures

GROUNDING CLIP FOR USE WITH SHIELDED, JACKETED FLAT CABLE

BACKGROUND OF THE INVENTION

The present invention relates to grounding terminations for shielded cables and, more particularly, to a metallic grounding clip for use with a shielded, jacketed flat cable.

The use of flat cables for interconnecting components of electrical and electronic equipment has been rapidly increasing. Flat cable allows high density wiring, offers a neat appearance, and is conducive to use with labor saving mass termination insulation displacement connectors. It is sometimes necessary to shield the signal conductors in the flat cable from stray voltages or current induced by electrical fields by surrounding the conductors with a metal foil or braid connected to ground.

Typically, the shield is grounded by stripping away an end portion of the outer jacket of the cable, folding the exposed portion of the shield back over the jacket and bolting together a pair of metallic blocks with the exposed shield positioned therebetween. It will be appreciated that this grounding method is time consuming and operator judgment is required regarding the degree of tightening of the blocks. Inadequate tightening results in poor electrical contact between the blocks and the shield while excessive tightening of the blocks beyond the elastic limits of the jacket material and other insulation could result in short circuiting of the conductors. Additionally, this grounding method relies on the resiliency of the jacket and insulation to maintain firm contact between the blocks and shield. With age, the plastic material between the blocks loses its resiliency and takes a permanent set thereby degrading the contact between the foil and the blocks.

One recently proposed flat cable uses a conventional crimp terminal for grounding. The cable includes an isolator strip disposed between the insulation in which the signal conductors are embedded and the shield to make the shield readily separable from the conductor array. If the shield is to be grounded remote from the cable ends, openings are cut in the outer insulative layer and in the shield. The crimp terminal is slid beneath the shield and crimped. For further information regarding the structure and operation of such flat cable and grounding clip therefor, reference may be made by U.S. Pat. No. 4,300,017.

SUMMARY OF THE INVENTION

Among the several objects of the present invention may be noted the provision of an improved grounding clip for use with a shielded flat cable; the provision of such clip which compressively holds the shielded cable portion and the outer insulative cable sheath; the provision of such cable and clip which permits grounding at any desired location along the length of the cable, and avoids the time consuming steps of stripping away the jacket end and folding back the shield or cutting away components of the cable; and the provision of such clip which is fast and simple in application, has long service life, and is simple and economical to manufacture. Other objects and feature of the present invention will be in part apparent and in part pointed out hereinafter in the specification and attendant claims.

Briefly, the grounding clip of the present invention is for use with a shielded, jacketed flat cable. The clip is of one-piece resilient metallic construction and comprises a first arm, a second arm, and a web joining the arms and defining therewith a channel for receiving the shielded portion of the flat cable. The spacing between the arms in their as-formed condition, is less than the thickness of the shielded cable portion. The clip further includes at least one ear extending from the web for cooperating with one of the arms to deform a portion of the outer cable sheath. By forming a slit in the outer sheath at one side of the cable, the arms can be moved from the cable side to flank the shielded portion and compressively hold it therebetween.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 3:
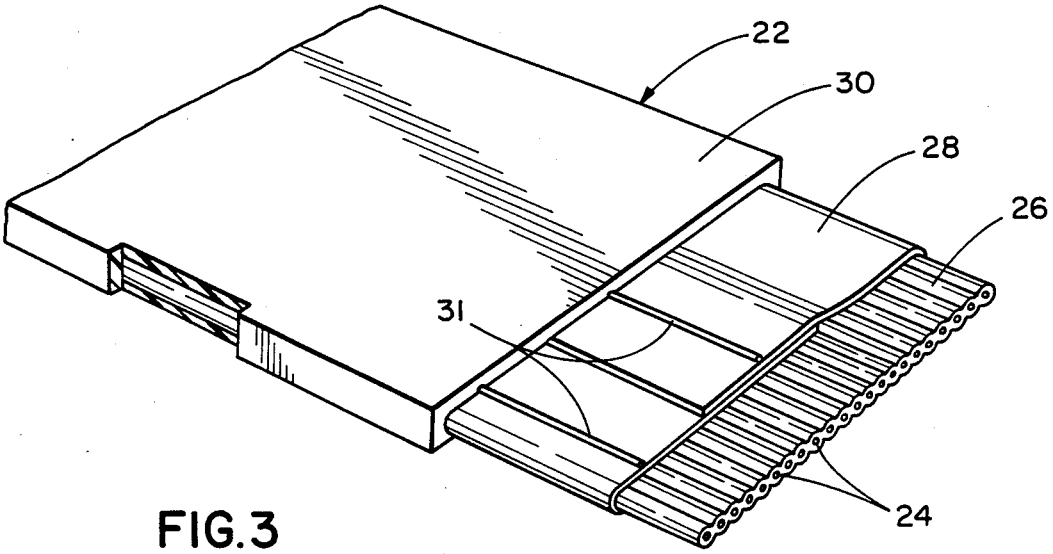
FIG. 3 is a perspective view of the shielded, jacketed flat cable with certain components removed to expose other components.

Referring now to the drawings, a grounding clip for use in connecting the shield of a flat cable 22 to ground is generally indicated by reference character 20. Clip 20, integral and of resilient metallic construction, is preferably made of a copper alloy and formed by bending components of a flat blank. Shielded, jacketed flat cable 22, best shown in FIG. 3, includes an array of generally parallel, regularly spaced conductors 24 extending intermediate the sides of the cable and embedded in a layer of insulation 26. A metallic shield 28, formed of foil or a braid, surrounds conductors 24, and the cable further comprises an outer sheath 30 of flexible, insulative material and one or more drain wires 31 disposed in contact with the shield. Preferably, both layer 26 and sheath 30 are made of a tough plastic such as polyvinyl chloride.

Grounding clip 20 comprises a first spring arm 32, a second spring arm 34 extending generally parallel to first arm 32, and a web 36 joining said arms and defining therewith a channel for receiving the shielded portion of the flat cable (that portion of the flat cable inside the outer sheath). The spacing between the arms, in the as-formed condition of the clip, is less than the thickness of the shielded cable portion. The clip also includes at least one ear 38 extending from web 36 for cooperating with one of the spring arms to hold a portion of outer sheath 30 by deforming it to mechanically hold the clip in its installed position of the cable.

Figure 1:
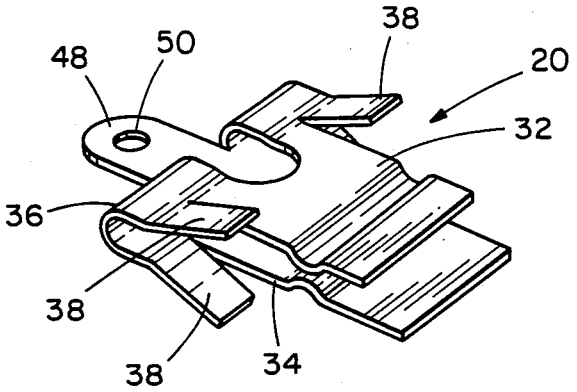
FIG. 1 is a perspective view of one embodiment of the clip of the present invention for grounding a shielded, jacketed flat cable.
Figure 2:
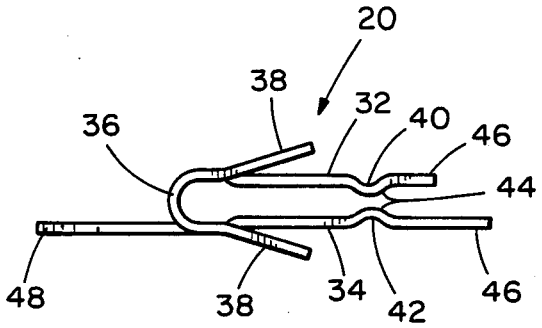
FIG. 2 is a front elevational view of the clip of FIG. 1.

More specifically, clip 20 includes four ears 38 with two ears flanking each arm. After the arms become disposed about the shielded portion, ear 38 corresponding to each arm are deformed toward their respective arm to bend a portion of the sheath between the arm and the ears. Each arm 32, 34 comprises a jaw 40, 42, respectively, for cooperating to compressively engage the shielded portion. As best shown in FIG. 2, each jaw is generally V-shaped in section, and each jaw has a ramp surface 44 for engagement by the shielded cable portion during application to cam the arms apart. Each arm also has an extension 46 from its jaw for deflecting away from the shielded cable portion, the portion of the sheath ahead of the jaws during application of the clip. Clip 20 also comprises a tab 48 projecting opposite the arms and having an aperture 50 for receiving a threaded fastener for connecting the clip to ground.

Figure 4:
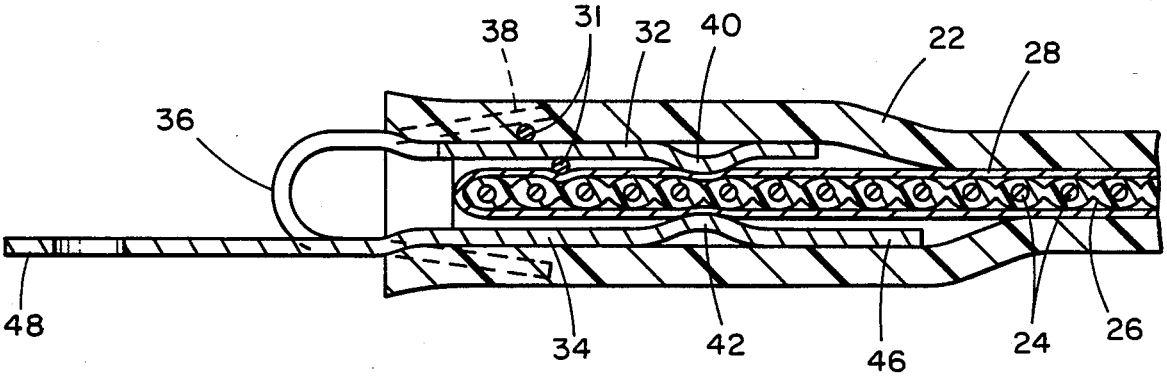
FIG. 4, similar to FIG. 2, is a sectional view showing the clip installed on a flat cable.

Referring to FIG. 4, two drain wires 31 are shown in association with the clip and the positions of these wires depicts alternate locations of a drain wire. The preferred location of drain wire 31 after clip installation is between, for example, jaw 40 and web 36 with the wire disposed between arm 32 and the sheath so that crimping of the ears 38 associated with arm 32 compresses the drain wire against the arm to insure good electrical and mechanical contact between the two. As an alternate desired location, the drain wire could be postioned between the jaw and web and compressed between arm 32 and the shielded cable portion.

Operation of the clip of the present invention is as follows: After determination of the desired position of one or more of the grounding clips along the length of cable 22, a short slit through outer sheath 30 is made in the longitudinal direction of the cable at one side thereof to expose the shielded portion. Extensions 46 are positioned to project into the slot, and the clip is moved transversely of the cable onto the shielded portion. Such movement causes the shielded portion to engage ramp surfaces 44 of the jaws resulting in camming apart of arms 32, 34 to permit relatively low force installation of the clip without damage to shield 28. However, due to the resiliency of spring arms 32, 34, shield 28 is held compressed between jaws 40, 42 thus establishing good electrical contact between the clip and shield at two locations. It is preferable but not essential to position drain wire 31 in one of the two locations shown in FIG. 4. Ears 38 are deformed by use of a simple tool, such as a pliers, so that the ears bite into the sheath and with their corresponding arms, deform the sheath to securely mechanically hold the clip to cable 22. Finally, the clip is connected to grounding using apertured tab 48.

As a method of installing a grounding clip on a flat cable, the present invention comprises the following steps:

(a) At one side of the flat cable, the outer sheath is slit to expose the shielded portion.

(b) Arms 32, 34 are inserted through the slit so that they can compressively engage the shielded portion.

(c) At least one of the ears 38 is deformed towards its corresponding arm to compress the outer sheath.

(d) The clip is connected to ground.

Figure 7:
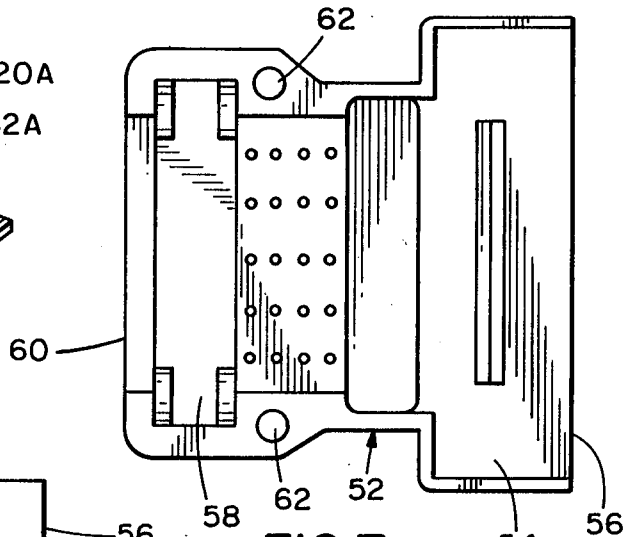
FIG. 7 is a plan of one of a pair of halves for together forming a housing of a connector assembly utilizing the clip of FIG. 6.
Figure 6:
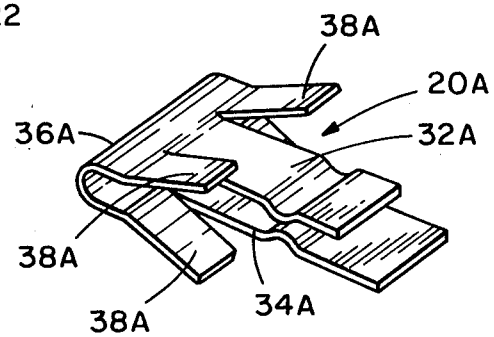
FIG. 6 is a perspective view of an alternative embodiment of the clip of the present invention.
Figure 8:
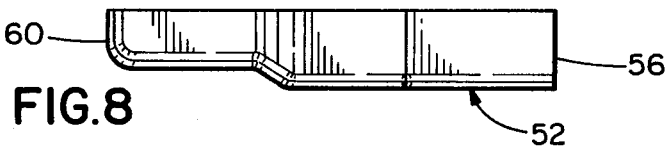
FIG. 8 is a side elevational view of the housing half of FIG. 7.
Figure 5:
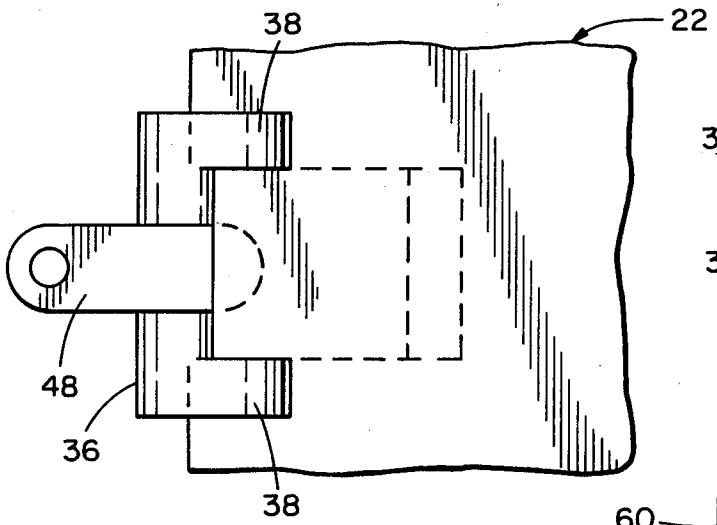
FIG. 5 is a plan view showing the clip of FIG. 1 installed on the flat cable.
Figure 9:
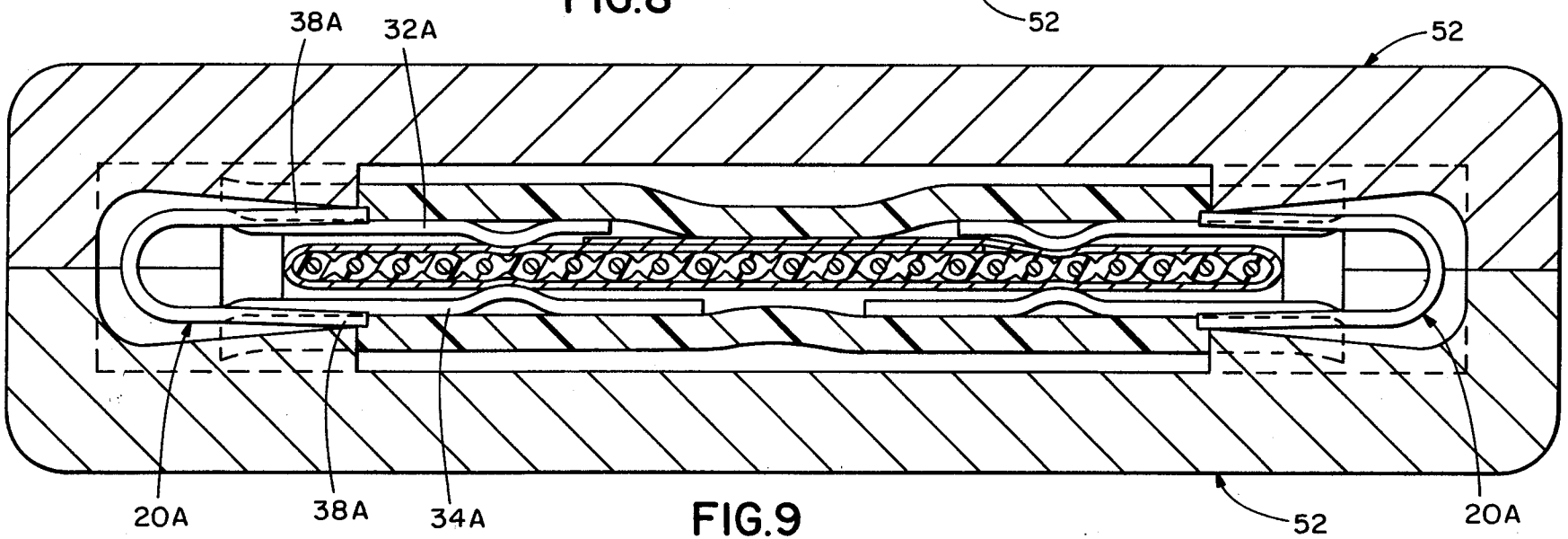
FIG. 9 is a sectional view of the connector assembly showing the operation of the clip of FIG. 6.

Referring now to FIG. 6, an alternate embodiment of the clip of the present invention is generally indicated by reference character 20A. Components of clip 20A generally corresponding to components of clip 20 are designated by the reference numeral assigned to the component of clip 20 with the addition of the suffix "A". Clip 20A is intended for use in a connector assembly for terminating flat cable 22. The assembly comprises a metallic housing having at least two components adapted to be assembled together. More specifically, each component is a housing half 52 shown in FIGS. 7 and 8. When assembled, the housing defines a cavity for receiving an end portion of cable 22, one and preferably two of clips 20A, and a connector for terminating the various conductors in the flat cable. The connector may be of the type having an insulative housing for holding an array of metallic terminal elements each having an insulation displacement portion for terminating one of the flat cable conductors, and a connection portion (such as a pin) for making contact with another electrical component. Such connectors are well known to those of skill in the art and need not be discussed further.

The housing cavity extends the length of the housing and, besides including the pass path of the cable, includes voids for receiving the connector and clips 20A. Each housing half 52 includes a deep recess 54 at its forward end 56 for seating the connector, a shallow recess 58 adjacent its rearward end 60 for receiving clips 20A, and an intermediate section disposed between the recesses and having an array of raised stipples extending into the pass path for the cable to indent sheath 30 to hold the cable from movement in the assembled housing.

Installation of clips 20A, which are disposed in alignment on opposite sides of the cable, is similar to that of clip 20 which is used to ground the cable intermediate its ends. However, after arms 32A, 34A are moved to compress the shielded cable portion, ears 38A are not deformed, they serve as means for making good electrical and mechanical contact with the housing when halves 52 are assembled by tightening threaded fasteners extending through apertures 62 in the housing halves. Ears 38A serve as spring arms and, after the clips 20A are located at the end of recess 58 and halves 52 brought together, tightening of the threaded fasteners to assembly the housing causes resilient deformation of the ears. The grounding path of the shield of the terminated flat cable includes arms 32A, 34A, the ears 38A and housing halves 52.

It will be appreciated that the embodiments of the clip of the present invention can be applied at any desired location along the length of the cable, or can be advantageously used with a connector termination assembly having a metallic housing. As the shield does not have to be bent back at the cable end, it is enabled to run the entire length of the cable to fully protect from induced voltages. It can be quickly and easily installed by merely making a slit in the outer sheath and without cutting away any parts of the insulation or sheath from the flat cable. Should the clip be improperly or erroneously installed, it is a simple matter to remove it by merely bending back the ears and pulling the clip from the cable.

In view of the above, it will be seen that the several objects of the present invention are achieved and other advantageous results attained.

As various changes could be made in the above constructions without departing from the scope of the present invention, it is intended that all matter contained in the above description shall be interpreted as illustrative and not in a limiting sense.

What is claimed is:

1. A one-piece resilient metallic grounding clip for use with a shielded, jacketed flat cable of the type including (1) an array of generally parallel, regularly spaced and coplanar conductors, extending intermediate the sides of the cable and embedded in a layer of insulation, (2) a metallic shield surrounding said conductors, and (3) an outer sheath of flexible insulative material; said clip comprising:

a first arm;

a second arm;

a web joining said arms and defining therewith a channel for receiving the shielded portion of the flat cable, the spacing between said arms being less than the thickness of said shielded portion; and an ear extending from said web for cooperating with one of said arms to deform a portion of said outer sheath whereby, upon forming a slit in the outer sheath at one side of the cable, said arms can be moved from said side to flank said shielded portion to compressively hold said shielded portion therebetween, each arm comprising a jaw, the jaws cooperating to compressively engage said shielded portion, at least one of said arms comprising an extension from its jaw for deflecting, away from the shielded portion, the portion of said sheath ahead of said jaw during application of said clip.

2. A clip as set forth in claim 1 further comprising one of said ears for cooperating with each arm for deforming portions of said sheath.

3. A clip as set forth in claim 1 further comprising a pair of said ears for cooperating with said one arm to deform said sheath.

4. A clip as set forth in claim 1 wherein said jaws have ramp surfaces for engagement by said shielded portion to cam said arms apart during application of said clip to said cable.

5. A clip as set forth in claim 1 further comprising a tab extending opposite said arms for connection to ground.

6. A method of grounding a shielded, jacketed flat cable with a one-piece resilient metallic grounding clip, said cable comprising an array of coplanar conductors embedded in a layer of insulation and extending between the cable sides with a metallic shield surrounding said conductors and an outer sheath of flexible insulative material; said clip comprising a first arm, a second arm, a web joining said arms and defining therewith a channel for receiving the shielded portion of the flat cable with the spacing between said arms being less than the thickness of said shielded portion, and an ear extending from said web for cooperating with one of said arms to deform said outer sheath; said method comprising the following steps:

slitting said outer sheath at one side of said flat cable intermediate the cable ends to expose said shielded portion;

inserting said arms through the slit so that they compressively engage said shielded portion;

deforming said ear toward said arm to compress the outer sheath; and connecting said clip to ground.

7. The combination of a one-piece resilient metallic grounding clip and a connector assembly for terminating a shielded, jacketed flat cable having an array of coplanar conductors embedded in a layer of insulation and extending intermediate the cable sides, a metallic shield surrounding said conductors and an outer sheath of flexible insulative material; said assembly comprising a metallic housing having at least two components adapted to be assembled together with said housing defining a cavity for receiving an end portion of said cable and a connector for terminating said conductors, said clip comprising:

a first arm;

a second arm;

a web joining said arms defining therewith a channel receiving the shielded portion of said cable, the spacing between said arms being less than the thickness of said shielded portion so that the shielded portion inserted in said channel is held compressively between said arms; and means for making good electrical and mechanical contact with said housing when said components are assembled.

8. The combination as set forth in claim 7 wherein the contact means comprises a resilient ear extending from said web.

9. The combination of a one-piece resilient metallic grounding clip and a shielded, jacketed flat cable of the type including (1) an array of generally parallel, regularly spaced and coplanar conductors, extending intermediate the sides of the cable and embedded in a layer of insulation, (2) a metallic shield surrounding said conductors, and (3) an outer sheath of flexible insulative material; said clip comprising:

a first arm;

a second arm;

a web joining said arms and defining therewith a channel for receiving the shielded portion of the flat cable, the spacing between said arms being less than the thickness of said shielded portion; and an ear extending from said web for cooperating with one of said arms to deform a portion of said outer sheath, said cable having a slit in the outer sheath at one side of the cable intermediate the ends of the cable, said arms extending through said slit to flank said shielded portion to compressively hold said shielded portion therebetween.

10. A combination as set forth in claim 9 wherein said clip further comprises one of said ears for cooperating with each arm for deforming portions of said sheath.

11. A combination as set forth in claim 9 wherein said clip further comprises a pair of said ears for cooperating with said one arm to deform said sheath.

12. A combination as set forth in claim 9 wherein each arm of said clip comprises a jaw, the jaws cooperating to compressively engage said shielded portion.

13. A combination as set forth in claim 12 wherein said jaws having ramp surfaces for engagement by said shielded portion to cam said arms apart during application of said clip to said cable.

14. A combination as set forth in claim 12 wherein at least one of said arms comprises an extension from its jaw for deflecting, away from the shielded portion, the portion of said sheath ahead of said jaw during application of said clip.

15. A combination as set forth in claim 12 wherein said cable further comprises a drain wire contacting said shield, said drain wire being disposed between the jaw of said one arm and said web, and between said one arm and said sheath so that deformation of said ear compressively holds said drain wire against said one arm.

16. A combination as set forth in claim 9 further comprising a tab extending opposite said arms for connection to ground.

* * * * *